United States Patent [19]

Nakajima

[11] 4,283,605

[45] Aug. 11, 1981

[54] PIEZOELECTRIC SPEAKER

[75] Inventor: Shoji Nakajima, Neyagawa, Japan

[73] Assignee: Matsushita Electric Industrial Co., Ltd., Osaka, Japan

[21] Appl. No.: 26,539

[22] Filed: Apr. 2, 1979

[30] Foreign Application Priority Data

| | | | |
|---|---|---|---|
| Apr. 7, 1978 | [JP] | Japan | 53-46203[U] |
| May 31, 1978 | [JP] | Japan | 53-74642[U] |
| Nov. 1, 1978 | [JP] | Japan | 53-135585 |

[51] Int. Cl.[3] ..... H04R 17/00

[52] U.S. Cl. ..... 179/110 A

[58] Field of Search ..... 179/110 A

[56] References Cited

U.S. PATENT DOCUMENTS

| | | | |
|---|---|---|---|
| 3,548,116 | 12/1970 | Schafft | 179/110 A |
| 3,786,202 | 1/1974 | Schafft | 179/110 A |
| 4,078,160 | 3/1978 | Bost | 179/110 A |

*Primary Examiner*—Vincent P. Canney

*Attorney, Agent, or Firm*—Spencer & Kaye

[57] ABSTRACT

A piezoelectric speaker having a flat and stable output vs. frequency characteristic attained by coupling a damping ring to an annular ring-shaped area surrounded by two nodal lines at the first overtone of a piezoelectric vibrator. The vibrator has concentric nodal lines at a resonance and vibrates in a planar bending vibration mode. The central part of a conical-shaped diaphragm is coupled to the piezoelectric vibrator and is accommodated in a housing. An acoustic resistive material is coupled between the piezoelectric vibrator and the inner bottom surface of the housing.

10 Claims, 7 Drawing Figures

PIEZOELECTRIC SPEAKER

BACKGROUND OF THE INVENTION

This invention relates to a loudspeaker using a piezoelectric vibrator. When a piezoelectric vibrator is used as a driving source of an electro-mechanical or an electro-acoustic transducer, the efficiency of the transducer is much higher than that of other transducers such as the dynamic and electromagnetic types. For example, if we take a speaker as an electro-acoustic transducer, while the transducing efficiency of the usual dynamic type speaker is around 1% , that of a speaker using a piezoelectric vibrator is 15 to 20 times larger, i.e. 10 to 20%. Therefore, efforts have been made to apply a piezoelectric vibrator to an electro-acoustic transducer as a driving source. However, it is required that the speaker performance by such that the output vs. frequency characteristic be flat in a definite frequency range and this requirement is not satisfied by merely combining a piezoelectric vibrator with an electro-acoustic transducer. The reason is that the piezoelectric vibrator has a resonance at a particular frequency such that the output at that frequency becomes much larger than at other frequencies. Methods have been used to overcome this difficulty by controlling the voltage of the driving source of the piezoelectric vibrator or by wrapping the entire vibrator with a material having a large mechanical loss. However, this structure is too complicated and the effect unsatisfactory.

SUMMARY OF THE INVENTION

According to the present invention, a metal or a resin damping ring is made to adhere to an annular surface surrounded with two nodal lines at the first overtone of a piezoelectric vibrator, which has concentric circular nodal lines and makes a planar bending vibration at resonance, to damp the output level of the first overtone to be substantially equal to the output level of the fundamental resonance. A tip in the central part of a conical-shaped diaphragm is coupled to the surface of the piezoelectric vibrator to which the damping ring adheres near the center of the vibrator, in registration with a polarity indication mark pattern-printed on the center of the electrode of the vibrator as a guide. Further, one end of an acoustic resistive material having nearly the same adhesion diameter as the smaller diameter of the two nodal lines caused at the first overtone is made to adhere to the surface opposite to the surface of the vibrator joined with the conical-shaped diaphragm. The other end of the acoustic resistive material is made to adhere to the inner bottom surface of a housing so as to divide the air space defined between the piezoelectric vibrator and the housing and to reduce the interference appearing therebetween. This speaker arrangement provides in this manner a piezoelectric speaker having a flat output vs. frequency characteristic in a required output frequency range which is capable of reducing variation in the output frequency characteristic in the case of mass production. Namely, this invention aims to flatten the output vs. frequency characteristic of a piezoelectric speaker and stabilize the characteristic during mass-production.

BRIEF DESCRIPTION OF THE DRAWINGS

Further objects, features and advantages of the present invention are described with reference to the following drawings, in which.

DESCRIPTION OF THE PREFERRED EMBODIMENTS

Figure 1:
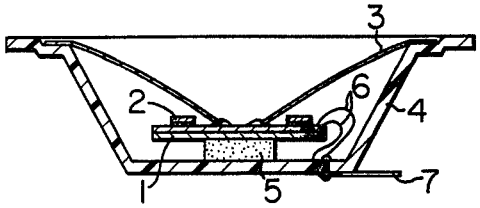
FIG. 1 is a cross-sectional view of the structure of a piezoelectric speaker according to this invention.

FIG. 1 shows an example of the structure of a piezoelectric speaker according to the present invention. The vibration system of the speaker is constituted in such a manner that a metal or resin damping ring 2 is coupled, as shown in FIG. 3, by adhesive to a part or whole of the surface surrounded by nodal lines 12 and 13 (in FIG. 2B) at the first overtone of a piezoelectric vibrator 1 (comprising two sheets of piezoelectric elements adhered to each other and usually called a piezoelectric bimorph). The central tip portion of a conical-shaped diaphragm 3, or a ring shaped region of the vibration diaphragm 3 (i.e. the upper small diameter portion of the frustum of a cone) which results by horizontally cutting away the upper portion of the cone) to have a diameter much smaller than the outer diameter of the piezoelectric vibrator 1 is joined with or coupled by adhesive to the surface coupling with the damping ring 2. One end of an acoustic resistive material 5 is coupled by adhesive in the neighborhood of the center of the surface of the piezoelectric vibrator 1 opposite the surface joined to the diaphragm 3. The peripheral portion of the diaphragm 3 is fixed by adhesive to the peripheral portion of a housing 4. The other end surface of the acoustic resistive material 5 is fixed by adhesive to the inner bottom surface of the housing 4. Leadwires 6 are led out from the piezoelectric vibrator 1 and connected to a terminal 7 provided on the bottom surface of the housing 4. Thus the piezoelectric speaker is constructed. In this case, the piezoelectric vibrator 1 is held in a space in the housing by the diaphragm 3 and the acoustic resistive material 5, so that the diaphragm 3 can be excited by the inertia of the piezoelectric vibrator 1.

Figure 4:
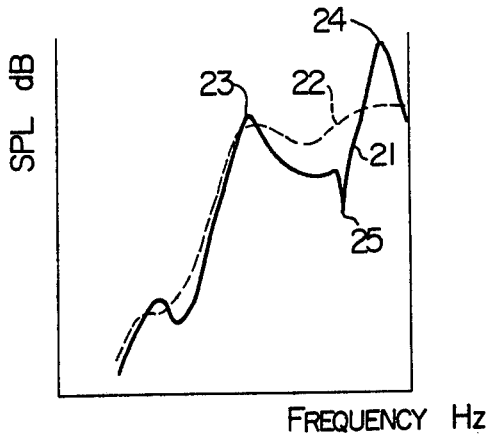
FIG. 4 shows an example of the output vs. frequency characteristic of a piezoelectric speaker.

Usually, the output vs. frequency characteristic of a piezoelectric speaker having a structure without such a damping ring 2 and an acoustic resistive material 5 is represented by a curve 21 shown in FIG. 4. The output peak level 24 at the first overtone is much higher than the output peak level 23 at the fundamental resonance. This is due to the fact that the force coefficient and mechanical resistance of vibrator 1 at the first overtone of the piezoelectric vibrator 1 is about four times as large as that at the fundamental resonance. The force coefficient is a coefficient indicative of the ratio of the mechanical output to the input voltage to a conventional piezoelectric vibrating element, and is given by the equation $F=AE$, where "F" is the mechanical output in newtons, "E" is the input voltage in volts and "A" is the force coefficient. Thus, the mechanical damping effect on resonance of the acoustic resistance given to the diaphragm 3 is smaller at the first overtone than at the fundamental resonance. Accordingly, the quality factor Q of the output peak level 24 of the secondary resonance is increased. Therefore, a method is needed to damp the first overtone more effectively than the fundamental resonance. In the vibration modes of the fundamental and first overtone shown in FIGS. 2A and 2B, the bending amplitude of the surface surrounded by the nodal lines 12 and 13 becomes larger at the first overtone than at the fundamental resonance. By the adhesion of the damping ring 2 with a rigidity and a mass suitable for damping the bending of the surface, the first overtone can be more effectively damped than the fundamental resonance. The output peak level 24 of the first overtone can be decreased to a level nearly equal to that of the output peak level 23 of the fundamental resonance. The damping ring 2 acts as a mechanical load to each resonance of the piezoelectric vibrator 1, reducing the Q of the resonance and increasing the apparent mass of the vibrator 1. Thus the inertia given to the diaphragm 3 is increased, and as shown by a curve 22 of FIG. 4 the output vs. frequency characteristic is effectively flattened.

Next, consider the damping effect of the damping ring 2 at the first overtone. The area occupied by the damping ring 2 in the surface between the nodal lines 12 and 13 varies with the material and the rigidity of the damping ring 2. Furthermore, when the inertia due to the mass of the damping ring 2 is to be increased, if the mass exceeds one third the mass of the piezoelectric vibrator 1, an excess damping is given to the piezoelectric vibrator 1, so that the output level is considerably decreased. Therefore, the design or selection of the material and shape of the damping ring 2 is an important point in flattening the output vs. frequency characteristic of the piezoelectric speaker.

The dip 25 in the characteristic curve 21 of FIG. 4 appears due to the fact that in the space surrounded by the housing 4 and the piezoelectric vibrator 1 the vibration of the vibrator surface between the nodal lines 12 and 13 and the vibration inside the line 13 have their respective phases reversed with respect to each other at or in the vicinity of the first overtone whereby interference occurs in the internal pressure of the area between the housing 4 and the vibrator 1 near the first overtone, the force coefficient abruptly decreasing to a low value as the frequency increases or decreases from the first overtone. In order to reduce this interference and obtain a flat characteristic as shown by the curve 22 of FIG. 4, the acoustic resistive material 5 is inserted between the housing 4 and the piezoelectric vibrator 1 in such a manner as to separate the area of the vibrator 1 inside the nodal line 13 from the area between the nodal lines 12 and 13.

As described above, the acoustic resistive material 5 functions to bisect the space defined by the piezoelectric vibrator 1 and the housing 4 and support the piezoelectric vibrator 1. The shape of the acoustic material can be freely selected and may be in a form such as a circular column or circular cylinder etc. Suitable materials may be gummous material such as vesicatory or foamed urethane, resin impregnated cloth and felt etc.

Figure 2A:
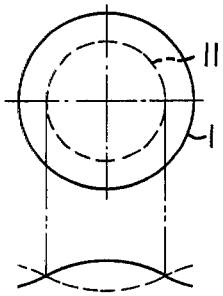
FIG. 2A shows the vibration mode of the piezoelectric vibrator at the fundamental resonance.
Figure 2B:
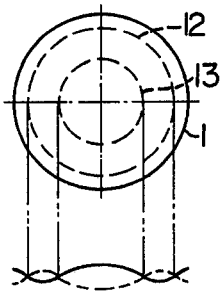
FIG. 2B shows the vibration mode of the piezoelectric vibrator at the first overtone.
Figure 3:
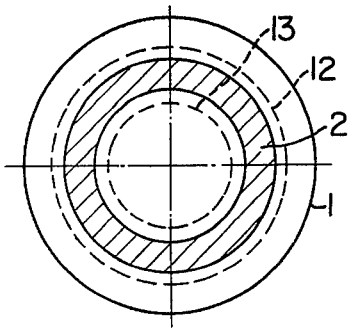
FIG. 3 is a top view of an example in which a damping ring is adhered to the piezoelectric vibrator.

The point of maximum amplitude of the piezoelectric vibrator 1 shown in FIGS. 2A and 2B lies in the central part of the piezoelectric vibrator 1. The nodal lines 11, 12 and 13 are formed concentric with respect to the central portion. Therefore, any eccentricity in the adhesive coupling of the damping ring 2 and the diaphragm 3 damages considerably the above-mentioned effects. In order to avoid this, a mark 9 (FIGS. 5A and 5B) which also serves as an indication of polarity is provided in the central part of the electrode pattern 8 of the piezoelectric element to serve as a guide for preventing eccentricity. It is thus possible to reduce possible variations in the flatness of the output vs. frequency characteristic of the piezoelectric speaker in the case of mass production.

Figure 5A:
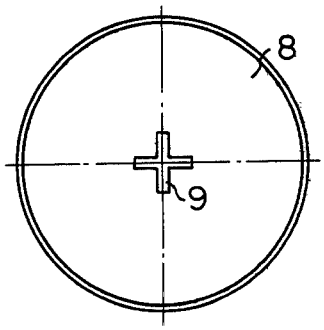
FIGS. 5A and 5B show examples of polarity indication marks.
Figure 5B:
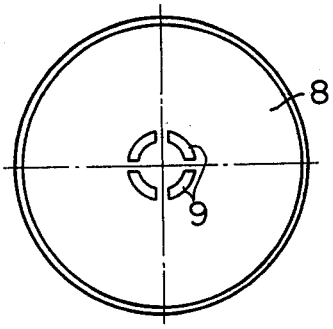

The mark 9 serving as a polarity indicator may be formed by metal evaporation, silver printing, electrolyteless plating etc. on the piezoelectric element, through the provision of a screen or a mask while the electrode 8 is formed. The form of mark 9 can be selected arbitrarily as shown in FIGS. 5A and 5B.

What is claimed is:

1. A piezoelectric speaker comprising a piezoelectric vibrator having first and second opposite surfaces, said vibrator vibrating in a planar bending mode so as to define a pair of spaced concentric nodal lines located on the first surface of said vibrator at the first overtone thereof;

a damping ring having a mass which is not greater than one-third of the mass of said piezoelectric vibrator affixed to the first surface of said vibrator only in the annular space between said first and second concentric nodal lines, said damping ring dampening vibrations at said first overtone;

a conical diaphragm having a central part thereof affixed to the central portion of the first surface of said vibrator, the part of said diaphragm affixed to said vibrator being surrounded by said damping ring;

a housing surrounding said piezoelectric vibrator, damping ring and conical diaphragm; and an acoustic resistive member attached to said housing and the second surface of said piezoelectric vibrator for supporting said vibrator, said acoustic resistive member having a diameter nearly equal to the diameter of the smaller of said nodal lines.

2. A piezoelectric speaker according to claim 1, wherein said damping ring is made of a metal.

3. A piezoelectric speaker according to claim 1, wherein said damping ring is made of a resin.

4. A piezoelectric speaker according to claim 1, wherein said damping ring is planar in shape.

5. A piezoelectric speaker according to claim 1, wherein said acoustic resistive material has the shape of a circular column.

6. A piezoelectric speaker according to claim 1, wherein said acoustic resistive material has the shape of a circular cylinder.

7. A piezoelectric speaker according to claim 1, wherein said acoustic resistive material is made of vesicatory gum.

8. A piezoelectric speaker according to claim 1, wherein said resistive acoustic material is formed of resin impregnated cloth.

9. A piezoelectric speaker according to claim 1, wherein said acoustic resistive material is made of felt.

10. A piezoelectric speaker according to claim 1 wherein a polarity indicator is formed in an electrode pattern at the center of said piezoelectric vibrator.

* * * * *